United States Patent [19]

Lunde et al.

[11] Patent Number: 4,994,860

[45] Date of Patent: Feb. 19, 1991

[54] LIQUID TONERS HANDLING NETWORK FOR AN ELECTROGRAPHIC PRINTER

[75] Inventors: George G. Lunde; Gregory L. Zwadlo; Larry J. Bresina, all of St. Paul, Minn.

[73] Assignee: Minnesota Mining and Manufacturing, St. Paul, Minn.

[21] Appl. No.: 507,379

[22] Filed: Apr. 10, 1990

[51] Int. Cl.[5] ..... G03G 15/10

[52] U.S. Cl. ..... 355/256; 354/324

[58] Field of Search ..... 355/256; 118/659, 660, 118/662; 354/323, 324

[56] References Cited

U.S. PATENT DOCUMENTS

| | | | |
|---|---|---|---|
| 3,916,828 | 11/1975 | Gross | 118/637 |
| 3,927,639 | 12/1975 | Plumadore | 118/637 |
| 3,964,828 | 6/1976 | Yamada et al. | 355/256 X |
| 3,972,610 | 8/1976 | Gross | 355/210 |
| 4,141,647 | 2/1979 | Lempke et al. | 355/256 |
| 4,398,818 | 8/1983 | Jeromin et al. | 355/256 |
| 4,613,226 | 9/1986 | Kimura et al. | 355/257 |
| 4,622,915 | 11/1986 | Ohtsuka et al. | 118/652 |
| 4,640,605 | 2/1987 | Ariyama et al. | 355/256 X |
| 4,669,860 | 6/1987 | Elliott | 355/206 |
| 4,760,425 | 7/1988 | Okano et al. | 355/256 X |
| 4,809,642 | 3/1989 | Kimura et al. | 118/662 |
| 4,870,462 | 9/1989 | Day | 355/256 |
| 4,878,090 | 10/1989 | Lunde | 355/256 |

FOREIGN PATENT DOCUMENTS

| | | | |
|---|---|---|---|
| 0306217A2 | 3/1989 | European Pat. Off. . | |
| 0012567 | 1/1985 | Japan | 355/256 |

*Primary Examiner*—Fred L. Braun
*Assistant Examiner*—William J. Royer
*Attorney, Agent, or Firm*—Kinney & Lange

[57] ABSTRACT

A liquid color toners handling network for an electrographic printer includes a plurality of developing modules. Each developing module in turn includes a toner handling system having a toner supply reservoir with a toner pump coupled to a reservoir outlet. A T-connector is coupled to the toner pump and is further coupled to a toner supply reservoir inlet. A three-way ball valve is coupled in series with the T-connector and an inlet of the developing module. An additional fluid line couples an outlet of the developing module back to the three-way ball valve. This arrangement allows toner to be trapped between the three-way ball valve and developing module inlet so that toner can be supplied to the developing module in an instant-on manner. The handling network further includes a toner carrier pumping module that can be coupled to any one of the supply reservoirs and a toner concentrate supply container associated with each supply reservoir. This arrangement allows toner carrier and toner concentrate to be mixed within a static mixer associated with the supply reservoirs. A toner/air vacuum separator coupled betwen the developing module outlet and the three-way ball valve is further coupled to a vacuum pumping module. The vacuum pumping module includes a maintenance vacuum separator and a suction cleaning line that can be used to perform routine cleaning maintenance on the developing modules.

29 Claims, 3 Drawing Sheets

LIQUID TONERS HANDLING NETWORK FOR AN ELECTROGRAPHIC PRINTER

BACKGROUND OF THE INVENTION

This invention pertains generally to multicolor electrographic printing devices. In particular, the present invention is a handling network for liquid color toners used by an electrographic printer in developing multicolor prints.

Typically, to produce a multicolor print a photoconductive member of the electrographic printer is first charged to a uniform potential to sensitize its imaging surface. The charged surface of the photoconductive member is exposed to an image of an original document that is to be reproduced as a multicolor print. This procedure allows the photoconductive member to record an electrostatic latent image corresponding to the informational areas contained within the image of the original document.

To form a multicolor print, successive images of the original document are digitally color separated and then recorded on the photoconductive member. These latent images are developed with different colored liquid toners supplied from corresponding toner developing modules of a toner handling network. The color of the liquid toner in the particular developing module corresponds to the subtractive primary of the color of the respective digitally separated image. Electrographic printing is normally done with yellow, cyan and magenta liquid toners. Usually the electrographic printer also includes a developing module having black liquid toner since it is required in virtually all commercial color printing applications.

The different colored developed images are transferred from the photoconductive member to a print medium in superimposed registration with one another. A digital half tone screen is used to expose the latent images to create multisized dots that produce the varying color tones needed to duplicate the original document. Heat is usually applied to permanently fuse the image to the print medium to form a completed multicolor print.

A liquid color toners handling network for an electrographic apparatus is disclosed in the Gross U.S. Pat. No. 3,972,610. The toner supply network of this electrographic apparatus is in the form of a closed system that includes a toner reservoir containing a supply of liquid toner. A toner pick-up tube submerged beneath the surface of the liquid toner is connected by a supply conduit to a toner pump. The pump supplies liquid toner through a first supply line to a pressure relief or bypass valve having first and second outlet ports. The first outlet of the bypass valve is coupled with the toner reservoir through a second supply line. A third supply line couples the second outlet port of the bypass valve to a toner module processing assembly.

The processing assembly includes a first solenoid valve coupled to the third supply line through a filter element. The first solenoid valve is vented to the atmosphere and has an outlet port connected to an inlet port of a second solenoid valve of the processing assembly by a short length of tube. The short tube has an internal volume corresponding to the amount of liquid toner necessary to effectuate the development of a single image.

The second solenoid valve is vented to the toner reservoir through a conduit and includes an outlet port coupled by a first fluid line to an inlet port of the toner module. An outlet port of the toner module is connected to a toner vacuum separator which separates unused liquid toner from the air and returns the separated liquid toner by gravity back to the toner fluid reservoir. A vacuum line is also connected with the toner vacuum separator and is coupled to a vacuum pump that applies a negative pressure to the vacuum separator through a regulator.

With the toner module in position to effectuate the developing process, the first solenoid valve of the toner supply network is energized which causes liquid toner to be pumped from the toner reservoir through the first solenoid valve and the short tube to the second solenoid valve. With the second solenoid valve initially in the closed position, the liquid toner is returned to the toner reservoir. This procedure allows the short tube to be filled with the precise amount of liquid toner necessary for the development of the latent image.

When the short tube is filled with liquid toner, the first solenoid valve is then closed and simultaneously therewith the second solenoid valve is opened whereupon the metered amount of toner fluid contained within the short tube is supplied to the toner module. Liquid toner is drawn through the toner module under a low vacuum supplied by the vacuum pump. This procedure causes the precisely metered amount of liquid toner to be drawn across the toner module which in turn causes the development of the latent electrostatic image. Thereafter, the second solenoid valve is closed and unused liquid toner within the vacuum separator is returned by gravity to the toner reservoir. The toner handling network does not supply liquid toner to the toner module in an "instant-on" manner. The pump must first fill the short tube and the first and second solenoid valves must be simultaneously closed and opened, respectively, before liquid toner reaches the toner module.

There is a continuing need for improved liquid color toners handling networks for electrographic printers. In particular, there is a need for a toners handling network that can supply liquid color toners to the developing modules in an "instant-on" manner to help prevent liquid toner carrying lines from drying out between imaging cycles. Moreover, there is needed a network that is capable of recirculating liquid color toner through the pumping and vacuum systems, including a simple toner drain/refill method. In addition, there is a need for a handling network that is capable of mixing liquid toner concentrate and liquid toner carrier to form the final solution of liquid color toner. There is a need for a liquid color toners handling network that includes a vacuum source for developing module maintenance, to reduce the time required to perform routine care.

SUMMARY OF THE INVENTION

The present invention is a liquid color toners handling network for an electrographic printer. The handling network includes a developing module having a developer inlet and a developer outlet spaced therefrom. The developing module further includes a toner handling system having a toner supply reservoir for storing liquid color toner. The toner supply reservoir includes a reservoir inlet and a reservoir outlet. A toner pump is coupled in series for liquid toner flow with the reservoir outlet and a T-connector. A first fluid line couples the T-connector to the reservoir inlet.

A three-way ball valve having first and second open positions and first and second closed positions is coupled to the T-connector through a second fluid line. A third fluid line couples the three-way ball valve to the developer inlet. The three-way ball valve is coupled to the developer outlet by a fourth fluid line. The three-way ball valve in the first closed position allows the toner pump to recirculate liquid color toner from the supply reservoir through the T-connector and back to the supply reservoir. When the three-way ball valve is in the first open position, the toner pump pumps liquid color toner from the supply reservoir to the developing module. In the second open position of the three-way ball valve, liquid color toner within the fourth fluid line flows via gravity back to the liquid toner supply reservoir for storage. In addition, the three-way ball valve when moved to the second closed position, traps liquid color toner within the third fluid line so that toner can be supplied to the developing module in an "instant-on" manner when the three-way ball valve is moved to the first open position.

Liquid toner concentrate is supplied to the toner supply reservoir from a toner concentrate supply container through a fifth fluid line coupled to the first fluid line. The toner concentrate is pumped into the supply reservoir by a metering pump connected to the fifth fluid line. There are six developing modules in the handling network and each developing module includes its own toner handling system. Liquid toner carrier can be delivered to the supply reservoirs of any of the six developing modules from a toner carrier pumping module.

The toner carrier pumping module includes a toner carrier storage vessel and a sixth fluid line which couples the storage vessel to a carrier module valve mechanism. The carrier module valve mechanism includes six carrier module valves. One carrier module valve is coupled to each of the handling systems through the supply reservoirs. A metering pump which forms part of the sixth fluid line pumps the liquid toner carrier into the respective toner supply reservoir through the respective open carrier module valve when needed. The first fluid line includes a static mixer that mixes liquid toner carrier with the liquid toner concentrate to form the liquid color toner supplied by the developing module to be used in the developing process. Low level switches associated with the toner concentrate supply container and the toner carrier storage vessel indicate when liquid toner concentrate and liquid toner carrier, respectfully, need to be added to the handling network.

The third fluid line includes a flow control valve for regulating the amount of liquid color toner reaching the developing module in the first open position of the three-way ball valve. The third fluid line further includes a filter mechanism located between the three-way ball valve and the flow control valve for removing impurities and conglomerated toner particles in the liquid color toner flow. A liquid toner overflow line couples the developing module to the toner supply reservoir and allows liquid color toner that does not reach the developer outlet to be returned to the supply reservoir via gravity.

The fourth fluid line includes a toner/air vacuum separator that separates unused liquid color toner from air drawn into the developer outlet. The toner/air vacuum separator further acts to store liquid color toner when the three-way ball valve is in the first open position during the developing process. The handling network further includes a vacuum pumping module that is coupled to the six handling systems through their respective toner/air vacuum separators.

The vacuum pumping module includes a vacuum pump coupled to a vacuum module valve mechanism via a conduit. The vacuum module valve mechanism includes three, vacuum module three-way ball valves. One of the vacuum module ball valves is coupled to a pair of handling systems through their toner/air vacuum separators. The vacuum module ball valves allow the vacuum pump to service any one of the developing modules depending upon which one is currently being used in the developing process. The vacuum pumping module further includes a maintenance, toner/air vacuum separator coupled to the vacuum pump through a vacuum module valve element. The maintenance vacuum separator includes a suction cleaning line which permits the maintenance vacuum separator to be used to remove liquid color toner from the developing modules during toner cleaning maintenance. The maintenance vacuum separator includes a maintenance valve that allows waste toner fluids from maintenance procedures to be removed from the maintenance vacuum separator for disposal.

The toner handling system of each developing module further includes a first pressure switch associated with the T-connector and a second pressure switch associated with the third fluid line that monitor liquid color toner flow at those points. Each pump outlet line of the handling systems includes a manual ball valve member for removing liquid color toners from the toner handling systems. A spill pan positioned beneath the handling network contains toner liquid spills and a toner leak detector alerts printer operating personnel to possible toner leaks.

This liquid color toners handling network is relatively simple, and since it includes a toner concentrate supply container and a toner carrier pumping module, toner liquids can be easily added to the handling network. In addition, the liquid color toners can be automatically mixed within the individual handling systems instead of being premixed and then added to the handling network. The manual ball valve members within the pump outlet lines of the handling systems allow the handling network to be easily drained of liquid color toners. In addition, the three-way ball valves trap liquid color toners within the third fluid lines, thereby permitting color toners to be supplied to the developing modules in an "instant-on" manner. Trapping the color toner in the third fluid line helps to prevent the fluid lines and developing module from drying out between imaging cycles, and further helps to prevent air bubbles from forming in the color toner when the three-way ball valve is moved to the first open position. The maintenance vacuum separator and suction cleaning line allow for easy developing module toner cleaning maintenance.

DETAILED DESCRIPTION OF THE PREFERRED EMBODIMENTS

Figure 1:
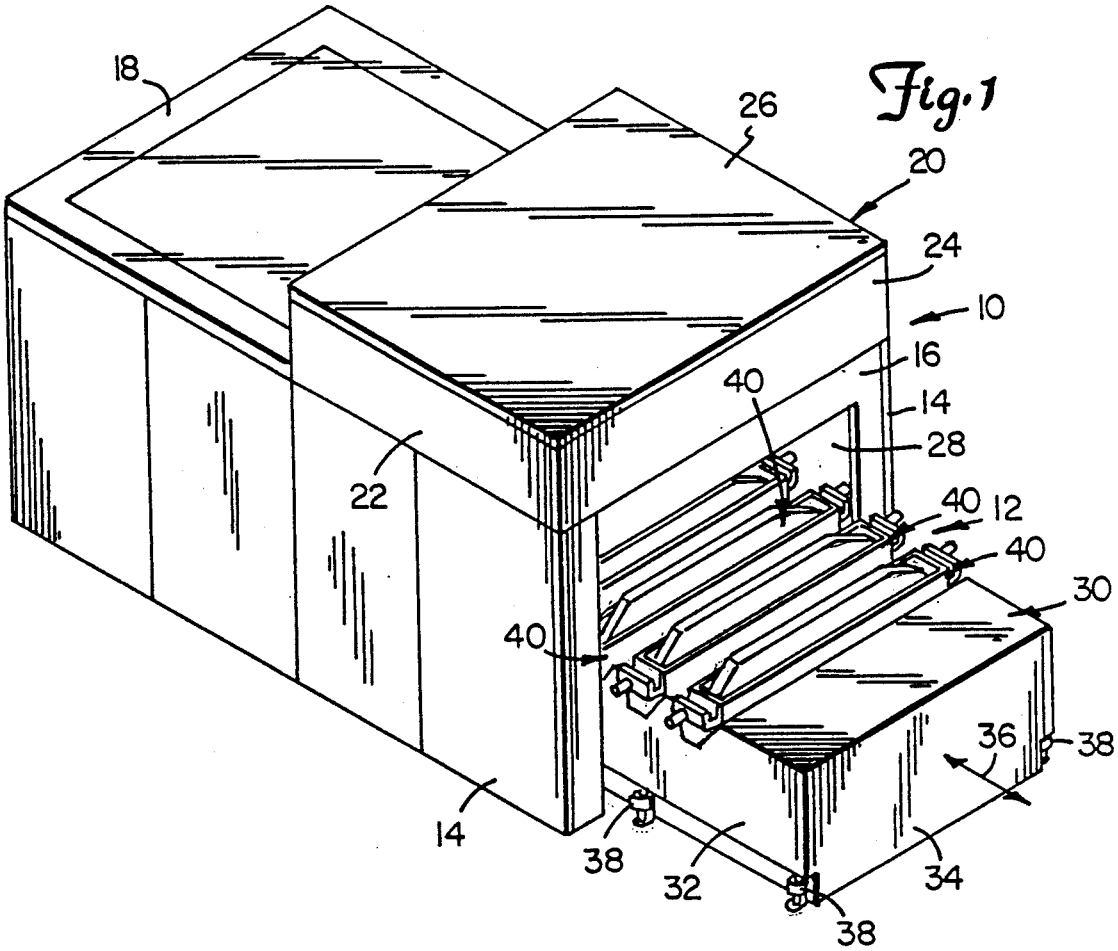
FIG. 1 is a perspective view of an electrographic printer with a toner cart which houses the liquid color toners handling network of the present invention.

An electrographic printer 10 which includes a liquid color toners handling network 12 in accordance with the present invention is illustrated generally in FIG. The liquid toners handling network 12 is illustrated in greater detail in FIGS. 2–5 and described in subsequent portions of this specification. However, a complete understanding of the handling network 12 will be facilitated by the following general description of the electrographic printer 10. The electrographic printer 10 includes a pair of side walls 14, a front end wall (not shown) and a rear end wall 16. The electrographic printer 10 further includes a lower top surface 18, and an upper section 20 formed by a pair of side walls 22 (only one of which is shown in FIG. 1), an end wall 24 and an upper top surface 26. An opening 28 is formed in the rear end wall 16 adjacent the upper structure 20 at a rear side of the electrographic printer 10.

As seen in FIG. 1, the handling network 12 is supported by a toner cart 30. The toner cart 30 includes a pair of side walls 32 (only one of which is shown in FIG. 1) and a pair of end walls 34 (only one of which is shown in FIG. The toner cart 30 is supported for over-the-floor travel by a plurality of casters (not shown). The casters permit the toner cart 30 with the handling network 12 to be moved away from the electrographic printer 10 for maintenance purposes or for replenishing the handling network 12 with various fluids needed for the developing process. As represented by the double arrow 36, the toner cart 30 is movable in and out of the confines of the electrographic printer 10 through the opening 28. The side walls 32 of the toner cart 30 include guide rollers 38 which are configured to contact guide rails (not shown) within th printer 10 to center the toner cart 30 relative to a photoconductor assembly.

DEVELOPING MODULES

The handling network 12 includes six developing modules 40 (only four of which can be seen in FIG. 1) supported by the toner cart 30. Each of the developing modules 40 supplies a different color of liquid toner to be used in a developing process performed by the photoconductor assembly. However, the handling network 12 can include any number of developing modules 40, depending upon the task normally performed by the electrographic printer 10. For example, one embodiment of the toner handling network 12 may include a single developing module 40 that supplies a single liquid color toner to be used by a printer 10 to develop black and white color separation film. The developing modules 40 are identical, hence, only one developing module 40 will be described with particularity. As seen best in FIG. 2, developing module 40 includes a shroud 42 that surrounds a development electrode 44. The development electrode 44 is in the form of an endless band 46 tensioned between an idler roller 48 and a drive roller 50. A drive motor 52 is coupled to the drive roller 50 and powers the drive roller 50 so as to continually move the band 46 past the photoconductor assembly during the developing process. As seen best in FIG. 3, a base member 54 within the shroud 42 supports the band 46 as it is driven by drive motor 52. The band 46 is formed of a conductive material, such as stainless steel, and is configured to carry a film of liquid toner to be used by the printer 10 during the developing process.

LIQUID COLOR TONER HANDLING SYSTEMS

Figure 2:
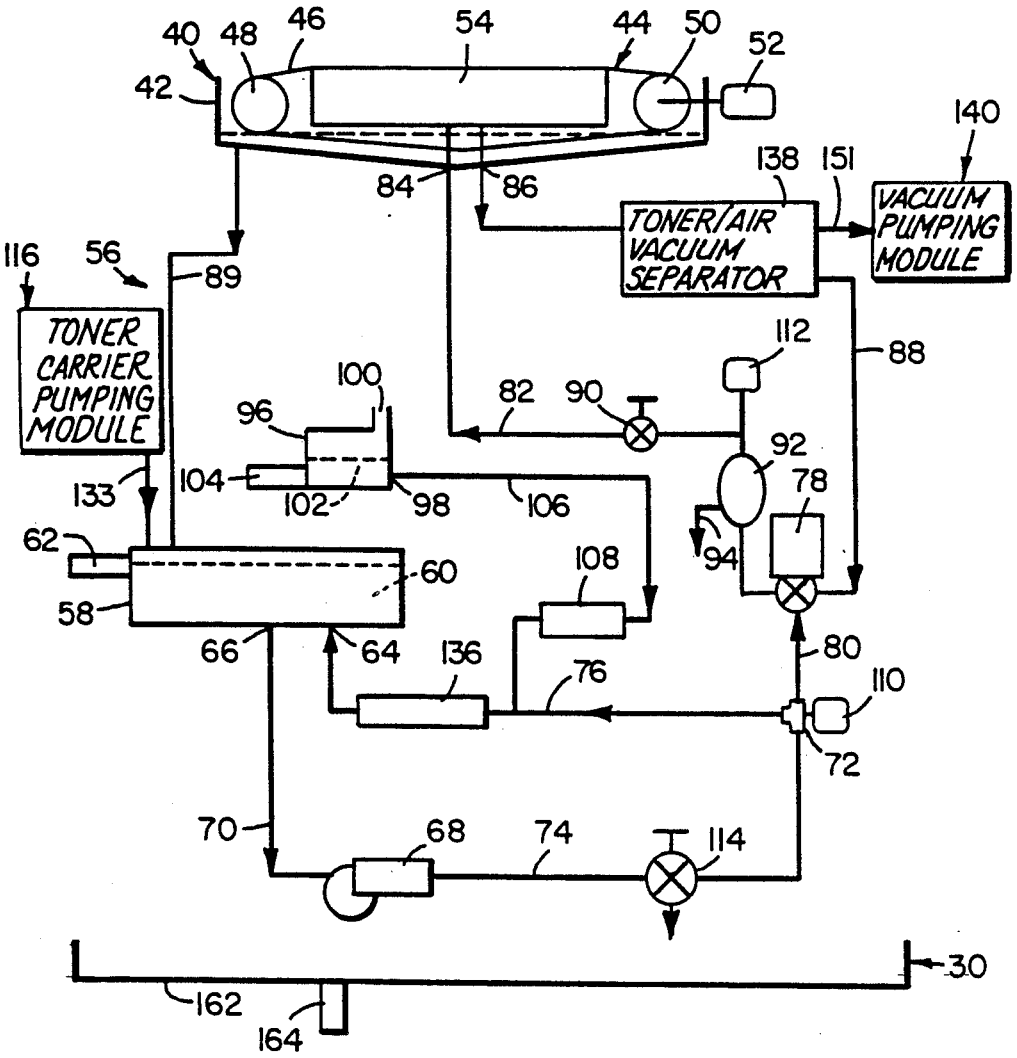
FIG. 2 is a block diagram view of a toner handling system for a single developing module that forms part of the handling network.

As seen in FIG. 2, each of the developing modules 40 of the handling network 12 includes its own liquid color toner handling system 56. The toner handling systems 56 of the developing modules 40 are identical, hence, only one toner handling system 56 will be described with particularity. Toner handling system 56 includes a liquid toner supply reservoir 58 that is adapted to hold a supply of liquid color toner 60. A liquid toner high level switch 62 on the supply reservoir 58 indicates to an operator of the printer 10 when the supply reservoir 58 is full of liquid toner 60 to prevent overfilling. The toner supply reservoir 58 further includes a reservoir inlet 64 spaced from a reservoir outlet 66. A toner pump 68 is coupled to the reservoir outlet 66 for liquid color toner flow by a pump inlet line 70. The toner handling system 56 further includes a T-connector or fluid connector 72 connected to the toner pump 68 by a pump outlet line 74. The T-connector 72 is further coupled to the reservoir inlet 64 by a first fluid line 76.

Figure 3:
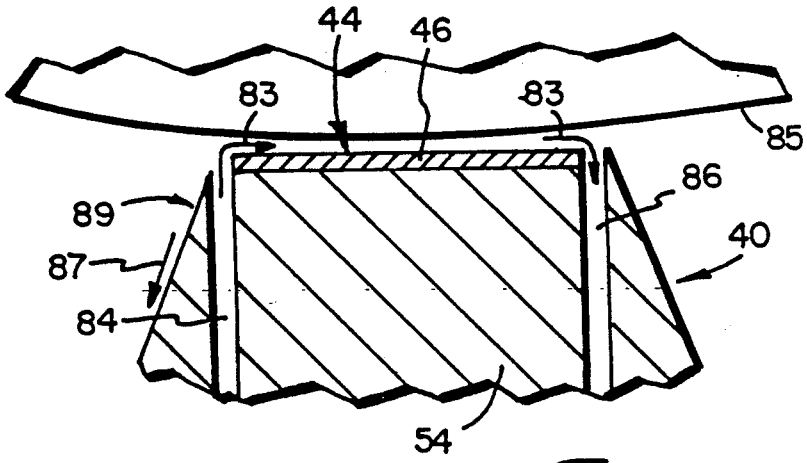
FIG. 3 is a sectional view showing components of one of the developing modules of the handling network.

As seen in FIG. 2, a three-way electric ball valve 78 having first and second open positions and first and second closed positions is coupled to the T-connector 72 for liquid color toner flow by a second fluid line 80. As seen in FIGS. 2 and 3, a third fluid line 82 couples the three-way ball valve 78, for forward liquid toner flow, to a developer inlet 84 of the developing module 40. A developer outlet 86 spaced from the developer inlet 84 by the development electrode 44 is coupled to the three-way ball valve 78 for return liquid toner flow by a fourth fluid line 88. A liquid toner overflow line 89 couples the developing module 40 to the toner supply reservoir 58. As seen in FIG. 3, with the toner pump 68 activated and the three-way ball valve 78 in the first open position, liquid color toner 60 flows from the developer inlet 84 across the development electrode 44 to the developer outlet 86 as shown by the flow arrows 83. During the imaging cycle of the developing process, liquid color toner 60 is deposited on a photoconductive member 85 (such as a photoconductor drum) of the photoconductor assembly as the color toner 60 flows across the development electrode 44. Liquid color toner 60 that is not deposited on the photoconductive member 85 or does not reach the developer outlet 86, is returned to the supply reservoir 58 via gravity through the overflow line 89 as represented by the flow arrow 87.

The third fluid line 82 of the toner handling system 56 includes a flow control valve 90 for regulating the amount of liquid color toner 60 reaching the development electrode 44. For maintenance purposes, the flow control valve 90 can be shut to prevent any liquid color toner 60 from reaching the developing module 40. The third fluid line 82 further includes a filter mechanism 92 located between the three-way ball valve 78 and the flow control valve 90 for removing impurities and conglomerated toner particles in the liquid color toner flow. A filter air bleed line 94 allows air to reach a filter contained within the filter mechanism 92 to dry out the filter prior to removal and replacement during routine maintenance.

As seen in FIG. 2, the toner handling system 56 further includes a replaceable, toner concentrate supply container 96, such as a bottle, having a container outlet 98 and an air vent 100. The concentrate supply container 96 holds a supply of liquid toner concentrate 102. A concentrate low level switch 104 associated with the supply container 96 indicates to an operator of the printer 10 when the concentrate supply container 96 currently in the handling system 56 is empty, so that it can be replaced with a full toner concentrate supply container 96. The container outlet 98 of the supply container 96 is coupled to the first fluid line 76 of the toner handling system 56 by a fifth fluid line 106. The fifth fluid line 106 includes a concentrate metering pump 108 which pumps toner concentrate 102 into the first fluid line 76 when needed. As an alternative to the concentrate low level switch 104, a counter (not shown) associated with the concentrate metering pump 108 could be used to indicate to an operator of the printer 10 when the toner concentrate supply container 96 currently in the handling system 56 is empty. The counter counts the number of strokes of the concentrate metering pump 108. When a predetermined number of toner concentrate metering strokes is reached indicating that the handling system 56 is out of toner concentrate 102, the operator of the printer 10 is alerted to replace the empty concentrate supply container 96 with a full concentrate supply container 96.

As seen in FIG. 2, the toner handling system 56 further includes a first pressure switch 110 associated with the T-connector 72 and a second pressure switch 112 associated with the third fluid line 82 that monitor liquid color toner flow at those critical points. In addition, the pump outlet line 74 includes a manual ball valve member 114 which is located at the lowest part of the toner handling system 56. The filter bleed line 94 acts as an air vent so that air can enter the handling system 56 and liquid toner 60 can be drained from the handling system 56 through the manual ball valve member 114.

TONER CARRIER PUMPING MODULE

Figure 4:
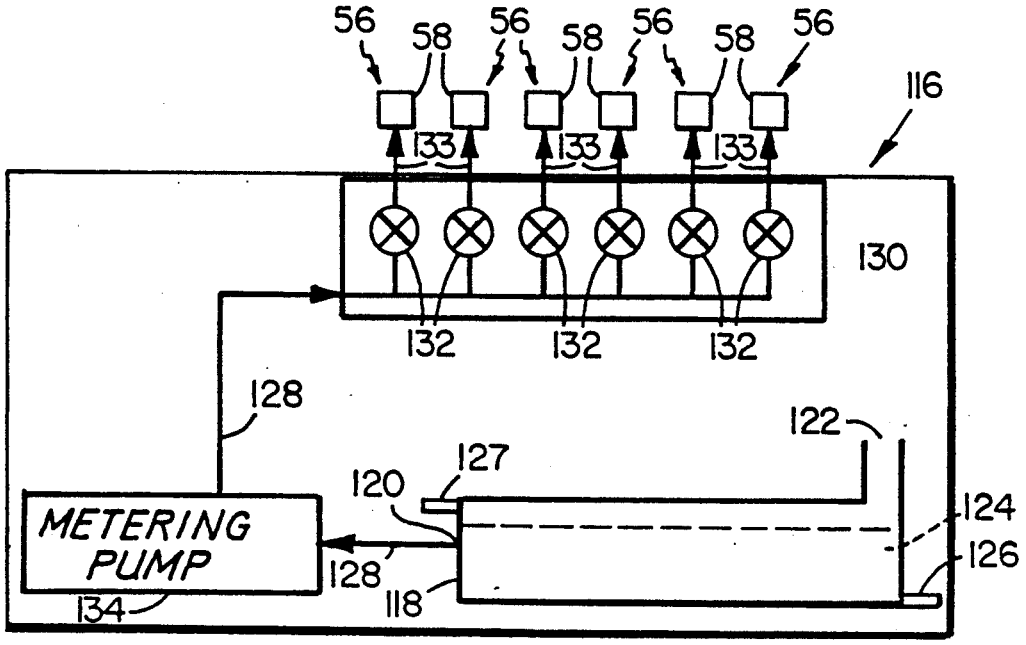
FIG. 4 is a block diagram view of the toner carrier pumping module of the handling network.

The toner handling network 12 further includes a toner carrier pumping module 116. As seen in FIG. 4, the toner carrier pumping module 116 includes a toner carrier storage vessel 118 mounted within the toner cart 30. The toner carrier storage vessel 118 includes a vessel outlet 120 and a fill port 122. The storage vessel 118 is adapted to hold a supply of liquid toner carrier 124, such as ISOPAR G (Registered Trademark of Humble Oil & Refining Company), a nonpolar, branched, liquid hydrocarbon. The storage vessel 118 further includes a carrier low level switch 126 that indicates to an operator of the printer 10 when the storage vessel 118 needs to be refilled via the fill port 122. A carrier high level switch 127 on the storage vessel 118 indicates to an operator of the printer 10 when the storage vessel 118 is full of liquid toner carrier 124 to prevent overfilling.

A sixth fluid line 128 couples the storage vessel 118 to a carrier module valve mechanism 130. Carrier module valve mechanism 130 includes six carrier module valves 132. One of the carrier module valves 132 is coupled to each of the handling systems 56 through the supply reservoirs 58 via a first supply tube 133. The sixth fluid line 128 further includes a carrier metering pump 134. Any one of the carrier module valves 132 can be opened to permit the carrier metering pump 134 to deliver liquid toner carrier 124 to the toner reservoir 58 of the respective handling system 56 when needed.

As an alternative to the carrier low level switch 126, a counter (not shown) associated with the carrier metering pump 134 could be used to indicate to an operator of the printer 10 when the toner carrier storage vessel 118 is empty. The counter counts the number of strokes of the carrier metering pump 134. When a predetermined number of toner carrier metering strokes is reached indicating that the handling system 56 is out of toner carrier 124, the operator of the printer 10 is alerted to refill the empty storage vessel 118 with toner carrier 124.

The first fluid line 76 further includes a static mixer 136 which mixes together liquid toner concentrate 102 supplied from the toner concentrate supply container 96 and liquid toner carrier 124 supplied from the toner carrier storage vessel 118 to formulate the liquid color toner 60. Toner concentrate 102, toner carrier 124 and color toner 60 already in the supply reservoir 58 are mixed together to form an additional amount of color toner 60 as the toner pump 68 recirculates these liquids through the static mixer 136.

As seen in FIG. 2, the fourth fluid line 88 of each toner handling system 56 includes a toner and air (i.e., "toner/air') vacuum separator 138. The toner/air vacuum separator 138 separates unused liquid color toner 60 from air which has been drawn into the developer outlet 86 as the color toner 60 flows across the development electrode 44.

VACUUM PUMPING MODULE

Figure 5:
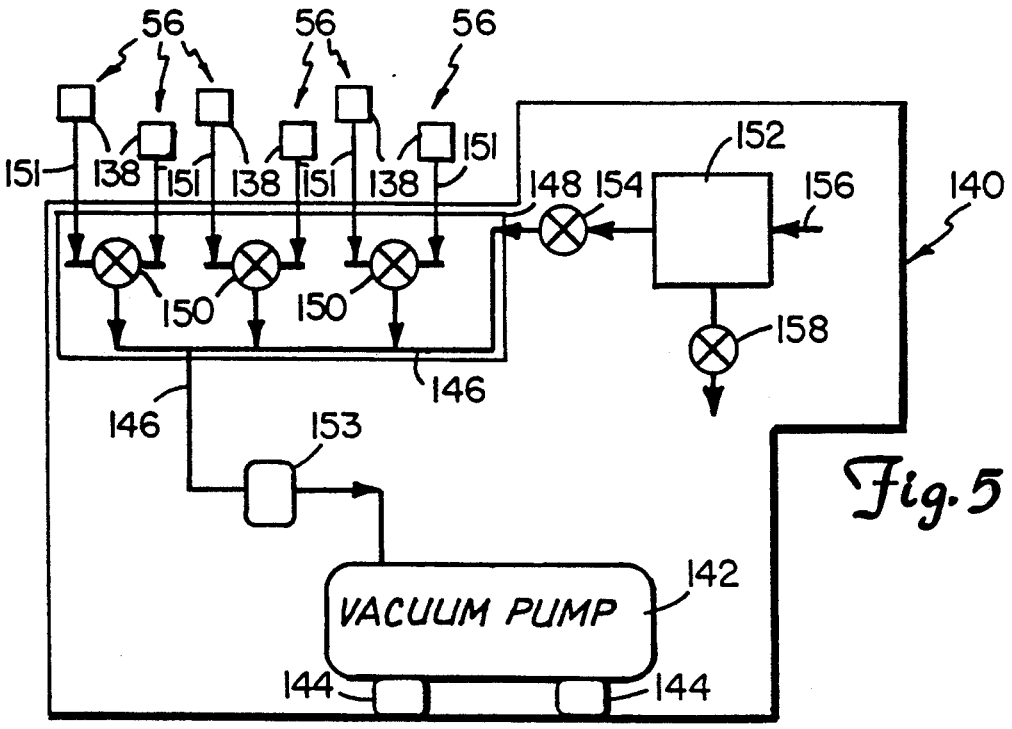
FIG. 5 is a block diagram view of the vacuum pumping module of the handling network.

The toner handling network 12 further includes a vacuum pumping module 140. As seen in FIG. 5, the vacuum pumping module 140 includes a vacuum pump 142 mounted within the toner cart 30 by a plurality of vibration isolators 144. A conduit 146 couples the vacuum pump 142 to a vacuum module valve mechanism 148. The vacuum module valve mechanism 148 includes three, vacuum module three-way ball valves 150. One of the vacuum module ball valves 150 is coupled to a pair of handling systems 56 through their respective toner/air vacuum separators 138 via second supply tubes 151. The vacuum module three-way ball valves 150 have two open positions and one closed position. In a first open position, the vacuum pump 142 services the toner/air vacuum separator 138 of one of the pair of respective handling systems 56, while in the second open position, the vacuum pump 142 services the toner-/air vacuum separator 138 of the other one of the pair of handling systems 56. In the closed position, no vacuum pressure is applied to either toner/air vacuum separator 138 of the pair of handling systems 56. One of the vacuum module ball valves 150 is moved to the first or second open position only when a respective developing module 40 is currently being used by the printer 10 in the developing process.

The conduit 146 includes a filter 153 situated between the vacuum module valve mechanism 148 and the vacuum pump 142 for removing impurities from the air separated from the unused liquid color toner 60 in the toner/air vacuum separators 138. As an addition, the vacuum pumping module 140 could include a backup toner and air vacuum separator (not shown) in the conduit 146. This backup vacuum separator would separate any unused liquid color toner 60 from air drawn into the developer outlet 86 that was not previously separated in the toner/air separators 138 of the handling systems 56.

As seen in FIG. 5, the vacuum pumping module 140 further includes an optional maintenance mechanism including a maintenance, toner and air (i.e., "toner/air') vacuum separator 152 which is coupled to the conduit 146 and thereby to the vacuum pump 142 by way of a vacuum module valve element 154, such as a manual ball valve. The maintenance vacuum separator 152 includes a suction cleaning line 156 that allows the maintenance vacuum separator 152 to be used to perform toner cleaning maintenance on the developing modules 40 when the vacuum module valve element 154 is open. The maintenance vacuum separator 152 further includes a maintenance valve 158, such as a manual ball valve, that permits the maintenance vacuum separator 152 to be drained of waste toner fluid from the maintenance process.

As seen in FIG. 2, the toner cart 30 includes a spill pan 162 for catching liquids that leave the toner handling network 12. The spill pan 162 includes a leak detector 164 that alerts an operator of the printer 10 when leaked fluids are contained within the spill pan 162.

OPERATION OF THE PREFERRED EMBODIMENT

The manner in which the toner handling system 56 for each developing module 40 operates is identical, hence, only the operation of one handling system 56 in conjunction with the toner carrier and vacuum pumping modules 116 and 140 of the handling network 12 will be described. With the three-way ball valve 78 in the first closed position, liquid color toner 60 is circulated by the toner pump 68 from the toner supply reservoir 58 through the T-connector 72 and the static mixer 136 and back to the supply reservoir 58. It is in this first closed position that additional liquid color toner 60 can be formulated. To mix additional liquid color toner 60, toner concentrate 102 is pumped into the first fluid line 76 from the supply container 96 by the concentrate metering pump 108, and toner carrier 124 is pumped into the supply reservoir 58 from the toner carrier pumping module 116 (i.e., through the respective open carrier module valve 132 from the storage vessel 118 by the carrier metering pump 134). Toner concentrate 102, toner carrier 124 and color toner 60 already in the supply reservoir 58 are mixed together to form an additional amount of color toner 60 as the toner pump 68 recirculates these liquids through the static mixer 136. Additional toner concentrate 102 and toner carrier 124 are added to the handling network by replacing the toner concentrate supply container 96 and refilling the toner carrier storage vessel 118.

To perform an imaging cycle of the developing process, the three-way ball valve 78 is placed in the first closed position and the toner pump 68 is activated to recirculate liquid color toner 60 through the supply reservoir 58 to build pressure within the handling system 56. Once sufficient pressure is obtained, the three-way ball valve 78 is moved to the first open position and color toner 60 is delivered to the development electrode 44 through the developer inlet 84 in an "instant-on" manner. The color toner 60 is delivered instantaneously to the development electrode 44 because color toner 60 from the previous imaging cycle is trapped within the third fluid line 82. Next, the vacuum pump 142 is activated and the appropriate vacuum module ball valve 150 is switched to the proper open position to draw the color toner 60 across the development electrode 44. Then the drive motor 52 is activated so as to continually move the endless band 46 relative to the base member 54. If needed, the flow control valve 90 can be adjusted so that a desired amount of color toner 60 is flowing to the developing module 40. The developing module 40 can now be moved into position adjacent the photoconductive member 85 so that the developing process can be performed.

During the developing process, color toner 60 that is not deposited on the photoconductor assembly is drawn into the toner/air vacuum separator 138 of the handling system 56 by the vacuum pump 142. Color toner 60 as well as air is drawn into the developer outlet 86 by the vacuum pump 142, and the color toner 60 is separated from the air inside the toner/air vacuum separator 138. During the developing process the color toner 60 is temporarily stored within the vacuum separator 138. Color toner 60 that does not reach the developer outlet 86 is returned via gravity directly to the supply reservoir 58 through the overflow line 89.

At the end of the developing process, the three-way ball valve 78 is moved to the second closed position which traps color toner 60 within the third fluid line 82. This prevents color toner 60 from draining back out of the developing module 40, thus preventing air bubbles from forming in the color toner 60 when the three-way ball valve 78 is moved to the first open position for the next imaging cycle. In addition, this prevents the fluid lines and developing module 40 from drying out between imaging cycles. Lastly, since color toner 60 is trapped in the third fluid line 82, color toner 60 is supplied to the development electrode 44 in an "instant-on" manner when the three-way ball valve 78 is moved to the first open position. With the three-way ball valve 78 in the second closed position, color toner 60 is no longer supplied to the development electrode 44 and the vacuum pump 142 draws excess toner from the photoconductive member 85 and air into the developer outlet 86.

Next, the developing module 40 is moved away from the photoconductive member 85, the vacuum module ball valve 150 is closed and the vacuum pump 142 and drive motor 52 are turned off. Then the three-way ball valve 78 is moved to the second open position to allow the color toner 60 held within the toner/air vacuum separator 138 to flow via gravity back to the supply reservoir 58. In the second closed position and the second open position of the three-way ball valve 78, color toner 60 is still trapped in the third fluid line 82. To complete an imaging cycle, the three-way ball valve 78 is moved back to the first closed position so that it is ready for the next imaging cycle. In the first closed position, liquid color toner 60 is still trapped in the third fluid line 82. This imaging cycle is repeated for each developing module 40 in the liquid color toners handling network 12 of the electrographic printer 10.

This liquid color toners handling network 12 is relatively simple, and since it includes a toner concentrate supply container 96 and a toner carrier pumping module 116, toner liquids can be easily introduced into the handling network 12. In addition, the liquid color toners 60 can be automatically mixed within the individual handling systems 56 instead of being premixed and then added to the handling network 12. The manual ball valve members 114 within the pump outlet lines 74 of the handling systems 56 allow the handling network 12 to be easily drained of liquid color toners 60. In addition, the three-way ball valves 78 trap liquid color toners 60 within the third fluid lines 82, thereby permitting color toners 60 to be supplied to the developing modules 40 in an "instant-on" manner. The maintenance vacuum separator 152 and suction cleaning line 156 allow for easy developing module toner cleaning maintenance.

Although the present invention has been described with reference to preferred embodiments., workers skilled in the art will recognize that changes may be made in form and detail without departing from the spirit and scope of the invention.

What is claimed is:

1. A liquid toners handling network, comprising:
   a plurality of developing modules, with each developing module having a liquid toner handling system, including:
   a toner supply reservoir for storing liquid toner;
   a fluid connector coupled to the supply reservoir for liquid toner flow; a toner pump coupled in series for liquid toner flow with the supply reservoir and the fluid connector; and
   a three-way valve coupled to the fluid connector for liquid toner flow, and further coupled to the developing module for forward liquid toner flow to the developing module and for return liquid toner flow from the developing module, the three-way valve having a first open position wherein the toner pump pumps liquid toner to the developing module, a first closed position wherein the toner pump recirculates liquid toner from the supply reservoir through the fluid connector and back to the supply reservoir, a second closed position wherein forward liquid toner flow is trapped between the three-way valve and the developing module so that liquid toner is delivered to the developing module instantly when the three-way valve is moved second open position wherein return the developing module and the three-way valve flows back to the supply reservoir for storage.

2. The liquid toners handling network of claim 1 wherein each handling system further includes:
   a toner concentrate supply container coupled to the supply reservoir for selectively delivering toner concentrate to the supply reservoir when needed.

3. The liquid toners handling network of claim and further including:
   a toner carrier pumping module, including:
   a toner carrier storage vessel; and
   a carrier module valve mechanism coupled in series for toner carrier flow with the storage vessel and each of the supply reservoirs of the handling systems, the carrier module valve mechanism allowing the storage vessel to deliver toner carrier to any one of the supply reservoirs as a function of which handling system needs additional toner carrier.

4. The liquid toners handling network of claim 1 wherein each handling system includes:
   a toner/air vacuum separator between the developing module and the three-way valve for removing air from the return liquid toner flow and for storing return liquid toner flow when the three-way valve is in the first open position.

5. The liquid toners handling network of claim 4, and further including:
   a vacuum pumping module, including:
   a vacuum pump; and
   a vacuum module valve mechanism coupled in series with the vacuum pump and each of the toner/air vacuum separators of the handling systems, the vacuum module valve mechanism allowing the vacuum pump to deliver a vacuum pressure to any one of the toner/air vacuum separators as a function of which one of the handling systems needs vacuum pressure.

6. The liquid toners handling network of claim 5 wherein the vacuum pumping module further includes:
   a maintenance vacuum separator; and
   vacuum module valve coupled between the maintenance vacuum separator and the vacuum pump, the vacuum module valve in an open position allowing the maintenance vacuum separator to be used to remove liquid toner from any of the developing modules when needed.

7. A liquid toners handling network for an electrographic printer, comprising:
   a developing module, including:
   a developer inlet; and
   a developer outlet;
   a development electrode oriented between the developer inlet and the developer outlet; and
   a liquid toner handling system, including:
   a toner supply reservoir for storing liquid toner, including:
   a reservoir inlet; and
   a reservoir outlet;
   a fluid connector;
   a toner pump coupled in series for liquid toner flow with the reservoir outlet and the fluid connector;
   a first fluid line coupling the fluid connector to the reservoir inlet;
   a three-way valve having first and second open positions, and first and second closed positions;
   a second fluid line coupling the three-way valve to the fluid connector;
   a third fluid line coupling the three-way valve to the developer inlet; and
   a fourth fluid line coupling the developer outlet to the three-way valve, the three-way valve in the first open position allowing the toner pump to pump liquid toner to the developing module, the three-way valve in the first closed position allowing the toner pump to recirculate liquid toner from the supply reservoir through the fluid connector and back to the supply reservoir, the three way valve in the second closed position trapping liquid toner within the third fluid line so that liquid toner is delivered to the developing module instantly when the three-way valve is moved to the first open position, and the three-way valve in the second open position allowing liquid toner in the fourth fluid line to flow back to the supply reservoir for storage.

8. The liquid toners handling network of claim 7, and further including:
   a toner concentrate supply container; and
   a fifth fluid line coupling the toner concentrate supply container to the first fluid line for delivering toner concentrate to the supply reservoir.

9. The liquid toners handling network of claim 8 wherein the fifth fluid line includes a metering pump to pump toner concentrate into the first fluid line.

10. The liquid toners handling network of claim 9 wherein a low level switch associated with the toner concentrate supply container indicates when the toner concentrate supply container is empty.

11. The liquid toners handling network of claim 8, and further including:

a toner carrier storage vessel; and a sixth fluid line coupling the toner carrier storage vessel to the toner supply reservoir for delivering toner carrier to the supply reservoir to be mixed with the toner concentrate supplied from the toner concentrate supply container.

12. The liquid toners handling network of claim 11 wherein the sixth fluid line includes a metering pump to pump toner carrier to the toner supply reservoir.

13. The liquid toners handling network of claim 12 wherein the toner carrier storage vessel includes a low level switch for indicating when toner carrier needs to be added to the storage vessel.

14. The liquid toners handling network of claim 11 wherein the first fluid line includes a static mixer for mixing toner concentrate and toner carrier to form liquid toner to be stored in the toner supply reservoir.

15. The liquid toners handling network of claim 7 wherein the third fluid line includes:

a flow control valve for regulating the amount of liquid toner supplied to the developing module in the first open position of the three-way valve; and a filter mechanism for removing impurities in the liquid toner flow.

16. The liquid toners handling network of claim 7, and further including an overflow line coupling -the developing module to the toner supply reservoir.

17. The liquid toners handling network of claim 7 wherein the fourth fluid line includes a toner/air vacuum separator for removing air from the liquid toner and for storing liquid toner when the three-way valve is in the first open position.

18. The liquid toners handling network of claim 16 and further including a vacuum pumping module coupled to the vacuum separator, including:

a vacuum pump coupled to the vacuum separator; and a maintenance mechanism including:

a maintenance vacuum separator coupled to the vacuum pump and a suction cleaning line coupled to the maintenance vacuum separator to allow liquid toner to be removed from the developing module during maintenance procedures.

19. The liquid toners handling network of claim 17 wherein the vacuum pumping module includes a filter located between the vacuum pump and the toner/air vacuum separator.

20. The liquid toners handling network of claim 7, and further including:

a first pressure switch associated with the fluid connector for monitoring liquid toner flow therethrough; and a second pressure switch associated with the third fluid line for monitoring liquid toner flow therethrough.

21. The liquid toners handling network of claim 16 including at least four developing modules, each developing module having a toner handling system.

22. The liquid toners handling network of claim 20 wherein the sixth fluid line of the toner carrier storage vessel includes a carrier module valve mechanism that allows the toner carrier storage vessel to be coupled to any one of the at least four developing modules.

23. The liquid toners handling network of claim 20 wherein the vacuum pumping module includes a vacuum module valve mechanism that allows the vacuum pump to be coupled to any one of the at least four developing modules.

24. The liquid toners handling network of claim 7 wherein the toner handling system includes a valve member for removing liquid toner from the toner handling system.

25. The liquid toners handling network of claim 7 wherein the toner handling network includes a spill pan and a liquid toner leak detector.

26. For use with an electrographic printer of the type configured to carry out a developing process and including a toners handling network having a developing module with a toner handling system that includes a toner supply reservoir, a fluid connector coupled to the supply reservoir, and a toner pump coupled in series with the supply reservoir and the fluid connector; a method for carrying out an imaging cycle of the developing process for the developing module, including:

providing the toner handling system of the developing module with a three-way valve coupled to the fluid connector for liquid toner flow, and further coupled to the developing module for forward liquid toner flow to the developing module and for return liquid toner flow from the developing module, the three way valve having first and second open positions, and first and second closed positions;

moving the three-way valve to the first closed position;

activating the toner pump to recirculate liquid toner from the supply reservoir through the fluid connector and back to the supply reservoir to build pressure within the handling system;

moving the three-way valve to the first open position to instantly deliver liquid toner to the developing module;

performing the developing process;

moving the three-way valve to the second closed position to trap forward liquid toner flow between the three-way valve and the developing module; and moving the three-way valve to the second open position to allow return liquid toner flow trapped between the developing module and the three-way valve to flow back to the supply reservoir for storage.

27. The method of claim 26, and further including the steps of:

providing the toners handling network with a plurality of the developing modules, with each developing module including its own toner handling system; and repeating the method for carrying out the imaging cycle for the developing module, for each developing module in the toners handling network.

28. The method of claim 26, and further including a method of resupplying the toner handling system with additional liquid toner, including:

providing the toner handling system with a toner concentrate supply container and a toner concentrate metering pump coupled in series with the toner supply reservoir; and activating the concentrate metering pump to deliver toner concentrate from the supply container to the supply reservoir when the three-way valve is in the first closed position.

29. The method of resupplying the toner handling system with additional liquid toner of claim 28, and further including the steps of:

providing the toner handling system with a static mixer, and a toner carrier pumping module having a toner carrier storage vessel and a toner carrier metering pump coupled in series with the supply reservoir; and activating the carrier metering pump to deliver toner carrier from the storage vessel to the supply reservoir when the three-way valve is in the first closed position so that the toner pump recirculates toner concentrate, toner carrier and liquid toner already within the handling system from the supply reservoir through the static mixer and back to the supply reservoir to form additional liquid toner.

* * * * *

PRINTER'S FORM LINE

UNITED STATES PATENT AND TRADEMARK OFFICE

CERTIFICATE OF CORRECTION

PATENT NO. : 4,994,860

DATED : February 19, 1991

INVENTOR(S) : George G. Lunde et al.

It is certified that error appears in the above-identified patent and that said Letters Patent is hereby corrected as shown below:

Col. 11, line 31, after "moved", insert --to the first open position, and a--.

Col. 11, line 32, after "return", insert --liquid toner flow trapped between--.

Col. 11, line 26, delete "-the", insert --the--.

Col. 11, line 40, delete "claim", insert --claim 1--.

Signed and Sealed this

Twenty-first Day of July, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,994,860

DATED : February 19, 1991

INVENTOR(S) : George G. Lunde, Gregory L. Zwadlo, Larry J. Bresina

It is certified that error appears in the above-identified patent and that said Letters Patent is hereby corrected as shown below:

Title page, [75], "George G. Lunde; Gregory L. Zwadlo; Larry J. Bresina, all of St. Paul, Minn." should read --George G. Lunde, Fridley, Minn.; Gregory L. Zwadlo, Ellsworth, Wisc.; Larry J. Bresina, St. Paul, Minn.--.

Col. 5, line 29, after "FIG" insert --1).--.

Col. 5, line 40, "th" should read --the--.

Signed and Sealed this

Fifteenth Day of June, 1993

*Attest:*

Michael K. Kirk

MICHAEL K. KIRK

*Attesting Officer*

*Acting Commissioner of Patents and Trademarks*